US005106278A

United States Patent [19]

Terwilliger

[11] Patent Number: 5,106,278

[45] Date of Patent: * Apr. 21, 1992

[54] REFRIGERANT GAS COMPRESSOR CONSTRUCTION

[75] Inventor: Gerald L. Terwilliger, Abingdon, Va.

[73] Assignee: Bristol Compressors, Inc., Bristol, Va.

[ * ] Notice: The portion of the term of this patent subsequent to Sep. 11, 2007 has been disclaimed.

[21] Appl. No.: 532,396

[22] Filed: Jun. 1, 1990

Related U.S. Application Data

[63] Continuation-in-part of Ser. No. 247,395, Sep. 21, 1988, Pat. No. 4,955,796.

[51] Int. Cl.[5] ..... F04B 39/08

[52] U.S. Cl. ..... 417/547; 417/550; 417/552

[58] Field of Search ..... 417/547, 550, 552, 553, 417/560; 251/357

[56] References Cited

U.S. PATENT DOCUMENTS

| | | | |
|---|---|---|---|
| T946,012 | 5/1975 | Willis | 417/550 |
| 1,661,266 | 3/1928 | Parshall | 417/552 |
| 1,663,737 | 3/1928 | Thompson | 417/552 |
| 2,193,243 | 3/1940 | Teeter | 417/550 |
| 2,506,751 | 5/1950 | Trask | 417/550 |
| 2,622,792 | 12/1952 | Ramclow | 417/550 |
| 2,920,861 | 1/1960 | Hartmann | 251/357 |
| 4,408,745 | 10/1983 | Swier et al. | 251/357 |
| 4,531,532 | 7/1985 | Zimmerly | 251/357 X |
| 4,955,796 | 9/1990 | Terwilliger | 417/547 |

FOREIGN PATENT DOCUMENTS

| | | | |
|---|---|---|---|
| 0272229 | 6/1988 | European Pat. Off. | 417/550 |

*Primary Examiner*—Leonard E. Smith

[57] ABSTRACT

A compressor asssembly, with particular reference to the suction side thereof, for a gas compressor having one or more cylinders, pistons mounted for reciprocation in the cylinders, cylinder head means mounted over the ends of the cylinders to provide discharge chambers, refrigerant discharge valve elements intermediate the head means and cylinders and providing compression chambers and adapted to open discharge passages to the discharge chambers for pressurized gas on the compression strokes of the pistons and to close the discharge passages on the suction strokes of the pistons, first suction gas inlet passages through the walls of the cylinders at positions remote from the cylinder head means, second suction gas inlet passages in the pistons extending through the outer walls thereof and in communication with the first passages over at least substantial portions of the travels of the pistons, suction gas ports in the tops of the pistons in communication with the second passages, the ports having port seats defining apertures through the tops of the pistons, and valve discs mounted in the upper portions of the pistons for limited axial, floating movement and having sealing surfaces or disc seats adapted to bear against the port seats on the compression strokes of the pistons to close off the second passages from the compression chambers, the floating movement being sufficient for movement of the disc seats away from the port seats to provide the suction gas ports with suitable open dimensions to allow adequate low-pressure refrigerant gas flow into the compression chambers during the suction stroke of the pistons.

24 Claims, 4 Drawing Sheets

REFRIGERANT GAS COMPRESSOR CONSTRUCTION

This application is a continuation-in-part of Applicant's copending Ser. No. 07/247,395 filed Sep. 21, 1988, now U.S. Pat. No. 4,955,796.

This invention concerns gas compressor construction having utility for compressing any gas, and having special utility for compressors of the type employed for refrigeration or air-conditioning systems including heat pumps and other air conditioning units for home or commercial use, wherein the compressor is electrically powered or mechanically powered as in automotive air conditioning systems, and wherein the compressor can be hermetically sealed, semi-hermetically sealed or open, and particularly concerns novel structural suction gas intake and discharge passage and valve design which afford substantial improvements in compressor operating characteristics including capacity and efficiency.

Such compressors as employed, for example, in closed-loop, central air conditioning or heating units, in window unit air conditioners or heating units, and in refrigeration units, are required to provide highly compressed refrigerant gas in a thermodynamically efficient manner which becomes quite difficult when load requirements increase the temperature of the compression system and effect a diminution in density of the suction gas being feed to and contained in the compression chamber. Also, it is desirable to keep the size and weight of such compressors to a minimum while engineering the unit to provide as much capacity and efficiency of operation as possible. Such engineering must take into consideration many factors in addition to that mentioned above, from both a structural and operational standpoint including inertia within the system, operating temperatures, resistance to damage by liquid refrigerant slugging, fatigue of metal or other parts through overflexing and the like, compressor and other noise sources, and capacity of gas flow passages.

The present invention has as its principal and general objects therefore, to provide a refrigerant gas compressor, the suction side of which is so constructed as to maintain a higher suction gas density than has heretofore been possible in equivalent equipment, and to thereby and by other structural innovations hereinafter described in detail, improve the overall operating capacity and efficiency of the compressor in a reliable and low cost manner.

These and other objects hereinafter becoming evident have been attained in accordance with the present invention which is defined in the context of a compressor assembly and with particular reference to the suction side thereof, as a gas compressor having cylinder means, piston means mounted for reciprocation in said cylinder means, cylinder head means mounted over the end of said cylinder means to provide discharge chamber means, gas discharge valve means intermediate said head means and cylinder means and providing compression chamber means and adapted to open discharge passage means to said discharge chamber means for pressurized gas on the compression stroke of said piston means and to close said discharge passage means on the suction stroke of said piston means, first suction gas inlet passage means through the wall of said cylinder means at a position remote from said cylinder head means, second suction gas inlet passage means in said piston means extending through the outer wall thereof and in communication with said first passage means over at least a substantial portion of the travel of said piston means, suction gas port means in the top of said piston means in communication with said second passage means, said port means comprising port seat means defining an aperture through the top of said piston means, and valve disc means mounted in the upper portions of said piston means for limited axial, floating movement and having sealing surface or disc seat means adapted to bear against said port seat means on the compression stroke of said piston means to close off said second passage means from said compression chamber, said floating movement being sufficient for movement of said disc seat means away from said port seat means to provide said suction gas port means with suitable open dimensions to allow adequate low-pressure refrigerant gas flow into said compression chamber during the suction stroke of said piston means.

In supplementary manner and as described in detail below, further innovations in the structure of the compressed gas discharge porting and in the novel physical relationship of the above piston means to this discharge porting at the apex of the compression stroke markedly contribute to maximization of the compressor efficiency and to the full realization of the above objectives. The present invention is useful for single or multicyclinder compressors having a wide variety of structural designs and configurations.

Heretofore, cylinder wall porting of suction gas has been employed as shown, for example, in U.S. Pat. Nos.: 2,033,437; 2,436,854; 3,490,683; and 3,915,597, however, due either to the configuration or placement of the porting, or to the type and complexity of suction valving employed, less than maximum thermodynamic efficiency and compressor capacity has been achieved through their use. It is noted that the U.S. Pat. No. 3,490,683 alludes to the desirability of cooler suction gas and adequate suction gas inlet flow, however, as is apparent from the principal inlet flow pattern adjacent to the hot cylinder head, the resistance of the spring closed inlet valve discs to inlet gas flow, and the limited volumetric capacity of the inlet passages, the structure proposed in this patent presents many operational deficiencies.

The invention in its broad aspects and in its preferred embodiments will be further understood from the following description and drawings, some of which are exaggerated in dimensions for clarity, and wherein.

Figure 1:
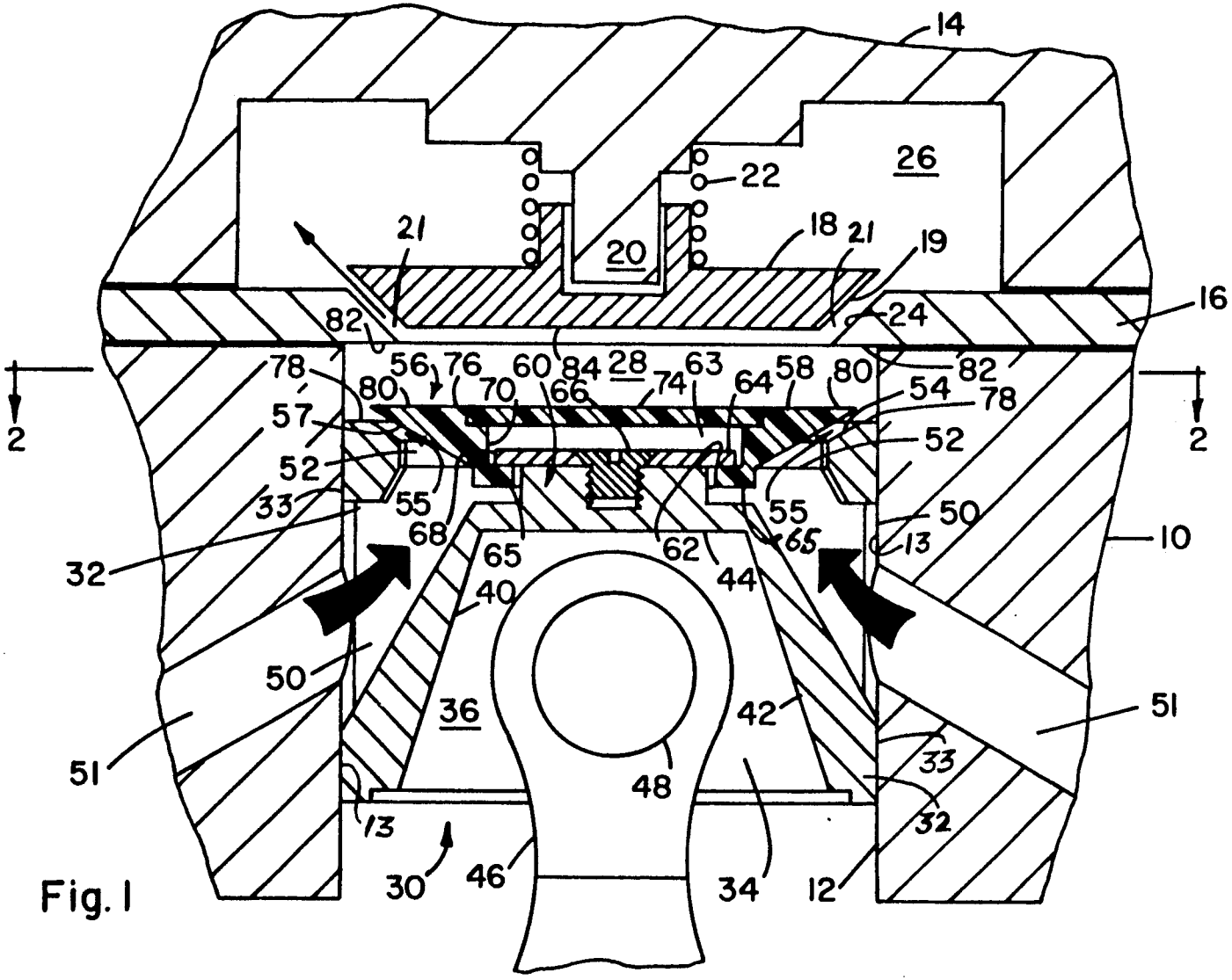
FIG. 1 is a cross-sectional side view of the relevant portions of a refrigerant compressor embodying the present invention.
Figure 5:
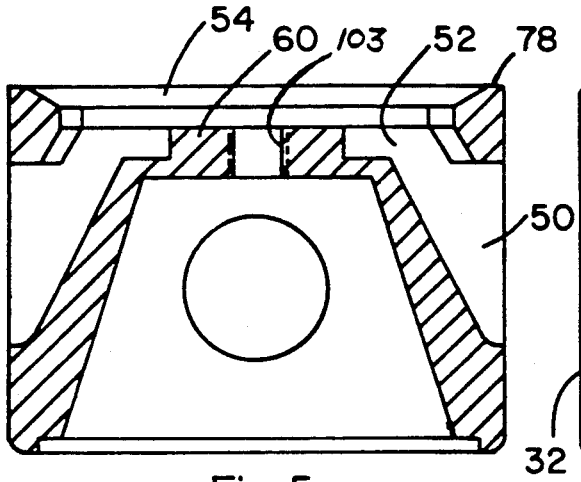
FIG. 5 is a view of the piston as in FIG. 1 with the valve disc and retainer removed for clarity and showing a through rivet aperture for affixing the retainer thereto.
Figure 3:
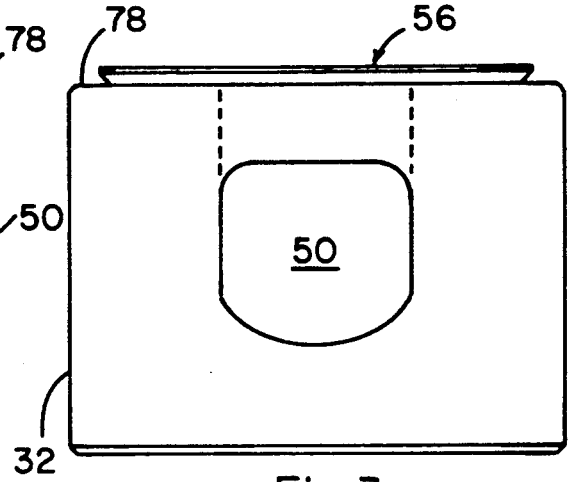
FIG. 3 is a side elevational view of the piston construction of FIG. 2 rotated 90° with the valve disc in its open position.
Figure 2:
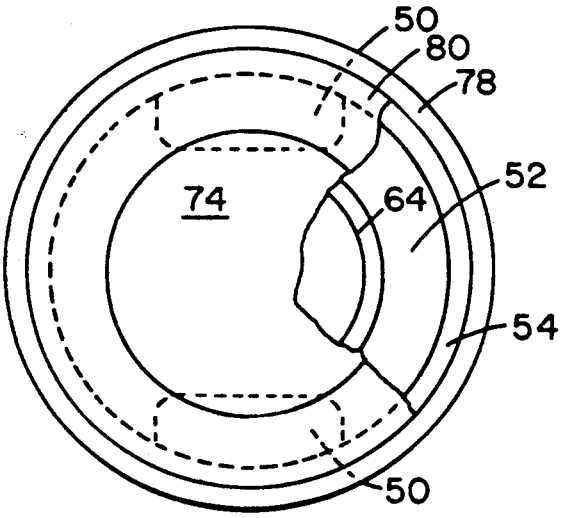
FIG. 2 is a view taken along line 2—2 of FIG. 1 in the direction of the arrows with a portion of the valve disc removed.
Figure 4:
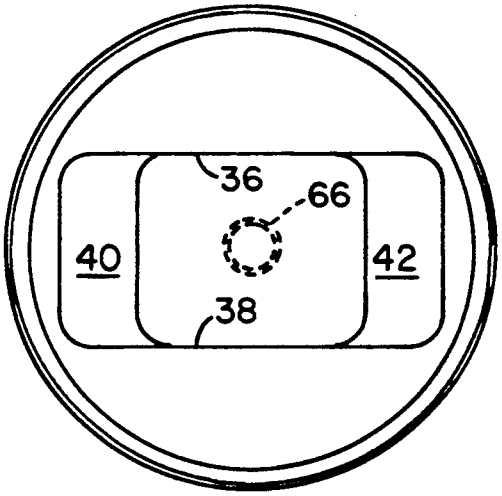
FIG. 4 is a view looking into the piston from the bottom.

Referring to the drawings, portions of a refrigerant compressor are shown comprising cylinder block 10 having a bore 12 formed therein in conventional fashion, a cylinder head 14, and a discharge porting plate 16 sandwiched and gasketed between the head block. A discharge valve 18 having seat 19 is axially slidably mounted on stud 20 of the head and continually urged by spring 22 toward seat 24 formed in porting plate 16 to isolate, in cooperation with the pressure differential across the discharge port, the compressed gas discharge chamber 26 from compression chamber 28 during the suction stroke of the piston. It is noted that insofar as the present invention is concerned, the general compressor structure not constituting part of the present invention, including certain elements of the cylinder block, cylinder head, discharge porting plate and discharge valve, and other components of the compressor and refrigeration unit and their function, may be of any conventional type such as shown, for example, in the aforementioned patents and others such as U.S. Pat. Nos.: 4,353,682; 2,863,301; 3,306,524; 3,509,907; and 4,537,566, the disclosures of which are incorporated herein by reference. For example, the drawing shows the discharge valve 18 seating in a porting plate 16, however, the valve seat can be integrally formed with the head 14 and the porting plate thus eliminated.

With more specific reference to the present invention, the present piston generally designated 30 comprises a generally cylindrical body 32 formed with a wrist pin cavity such as shown as 34 and defined by straight walls 36, 38, tapered walls 40, 42, and roof 44, for accommodating the connecting rod 46 and wrist pin 48 combination which pivotally connects the piston to the crankshaft in conventional manner. It is of course apparent that any conventional cavity configuration and connecting rodwrist pin combination can be employed for the present novel piston.

Referring further to the drawings, the present piston is provided with gas passage means which, in the embodiment shown, comprises a pair of large apertures 50 cut through the outer wall of the piston body on opposite sides thereof and extending inwardly and upwardly to communicate with a large annular cavity 52 which lies upstream and adjacent to annular suction gas port seat 54 defining a suction gas port aperture generally designated 55. Apertures 50, over at least a substantial portion of their areas, are in continuous gas flow communication with suction gas inlets 51 through opposite sides of the cylinder wall. Inlets 51 are adapted, of course, to be in communication by way of suitable conduit means to suction gas returned into the compressor housing preferably into a suction gas plenum substantially isolated from motor heat. The valve disc generally designated 56, in the embodiment shown in FIG. 1, is as aforesaid, mounted on or in the top or upper portions of the piston for limited axial motion which is a floating motion unhindered by any structural restraints. The disc is preferably of a strong, fairly inflexible plastic material capable of withstanding operating temperatures and pressures and include such polymers as KADEL E-1230, a polyketone of Amoco Performance Products, Inc., of Ridgefield, Conn., or the "Vespel" or others disclosed in columns 3 and 4 of U.S. Pat. No. 4,368,755, or can be metallic or ceramic or combinations thereof. The manner in which the disc is floatingly secured to the piston may be greatly varied and the structure used in the drawing, although very effective, is only exemplary.

The valve disc 56 and its seat 57, and the port seat 54 defining the opening 55 through the top of the piston, provide the suction gas port means. For reasons hereinafter discussed in some detail, the upper surface or compression side 58 of the disc is preferably flat. In the exemplary embodiment shown, the top of the piston is formed to provide a circular shaft-like projection 60 over and around which an annular attachment flange 62 of the disc is loosely mounted. The flange preferably comprises a shoulder means formed outwardly from the wall 70 of bore 63 formed axially in the disc body, and lying adjacent the suction side 65 of the disc body. Other shaft-like shapes for projection 60 such as square or the like may also be employed. Retaining means which is shown for exemplary purposes as a flat circular retainer plate 64 secured to projection 60 by machine screw 66 or equivalent mechanical means such as rivet, bolt and nut, weld, braze or the like, is adapted to abut the upper surface of flange or shoulder means 62 to prevent complete axial removal of the disc from the piston. The periphery 68 of plate 64 is adapted to abut the bore wall 70 of the valve disc to prevent radial displacement of the disc and thus insure proper seating of the annular sealing surface or seat 57 of the valve disc on the port seat 54 on the compression stroke. In this particular structure of the valve disc a circular access cover 74 is provided to complete the planar upper surface of the disc. This cover, which is affixed to the disc body by any suitable means such as threads 76, screws, plastic welding (solvent gluing), sonic welding, or any combination of these or other convenient means, allows the disc to be readily molded substantially as a monolith and assembled on the piston. It is noted that the access cover 74 may also be of plastic coated steel or the like should excessive flexing of the plastic material per se occur and present a problem.

Figure 6:
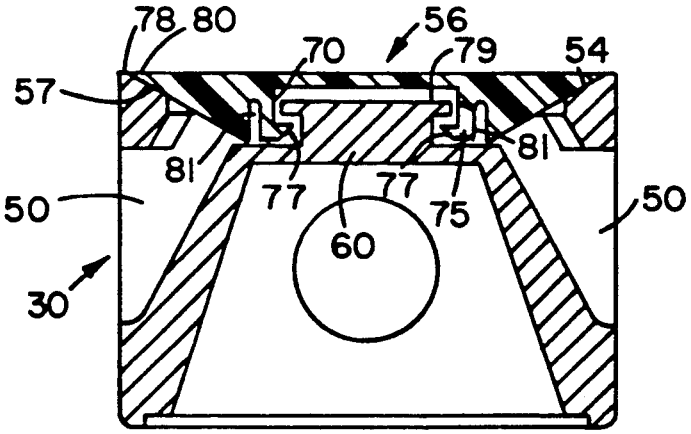
FIG. 6 is a cross-sectional view of the piston showing an alternative suction valve disc construction.
Figure 13:
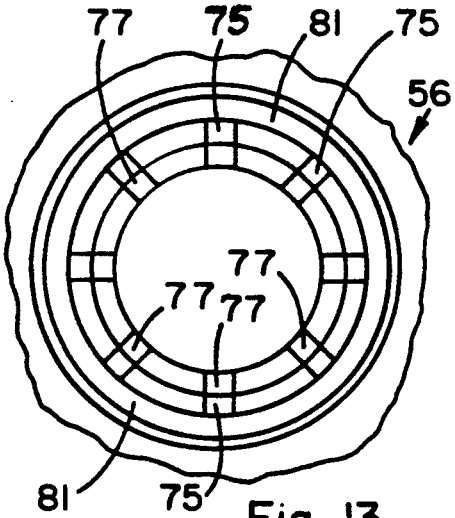
FIG. 13 is an elevational view of the valve disc of FIG. 6 viewed from the bottom or suction side.

In a preferred embodiment as shown in FIGS. 6 and 13, the valve disc 56 is a single molded piece provided on its lower side with a plurality of fingers 75 circumferentially spaced around the cavity formed by bore wall 70, the fingers preferably having beveled leading edges 77 for camming over the periphery of the annular retaining lip 79 preferably integrally formed on the equivalent of projection 60. An annular slot 81 formed in the bottom of the disc adjacent the radially outer edges of the fingers allows the fingers to flex radially outwardly they are pushed or snapped over the lip 79. A typical number of fingers for the disc size as shown is from about four to about sixteen. The flexible fingers alternatively may be provided on the peripheral portions of the retaining projection to provide equivalent snap-on capability, in which case, a member of suitable flexible material, e.g., plastic, can be secured to the top of the retaining projection to provide the flexible fingers operating in an up-side-down manner relative to the finger structure shown.

It is particularly emphasized here that in order for the effectiveness of the present invention to be realized to its maximum, the upper surface of the valve disc including the access cover should be essentially flat and lie in a single plane with the top or upper planar surface 78 of the piston when the valve disc is seated during the compression stroke. It is noted that surface 78 of the piston is planar even through it occupies a relatively small annular area, since all portions of the piston top adjacent the port seat 54 lie essentially in the same plane. This construction allows the top surface 78 of the piston and the radially outer portions 80 of the valve disc to be positioned immediately adjacent the annular inner surface 82 of the porting plate 16 such that the bottom surface 84 of the discharge valve 18, which is preferably shaped such that its compression side or surface 84 and the porting plate surface 82 can lie in a single plane, will lie immediately adjacent the upper surface 58 of the valve disc at the apex of the compression stroke.

Figure 7:
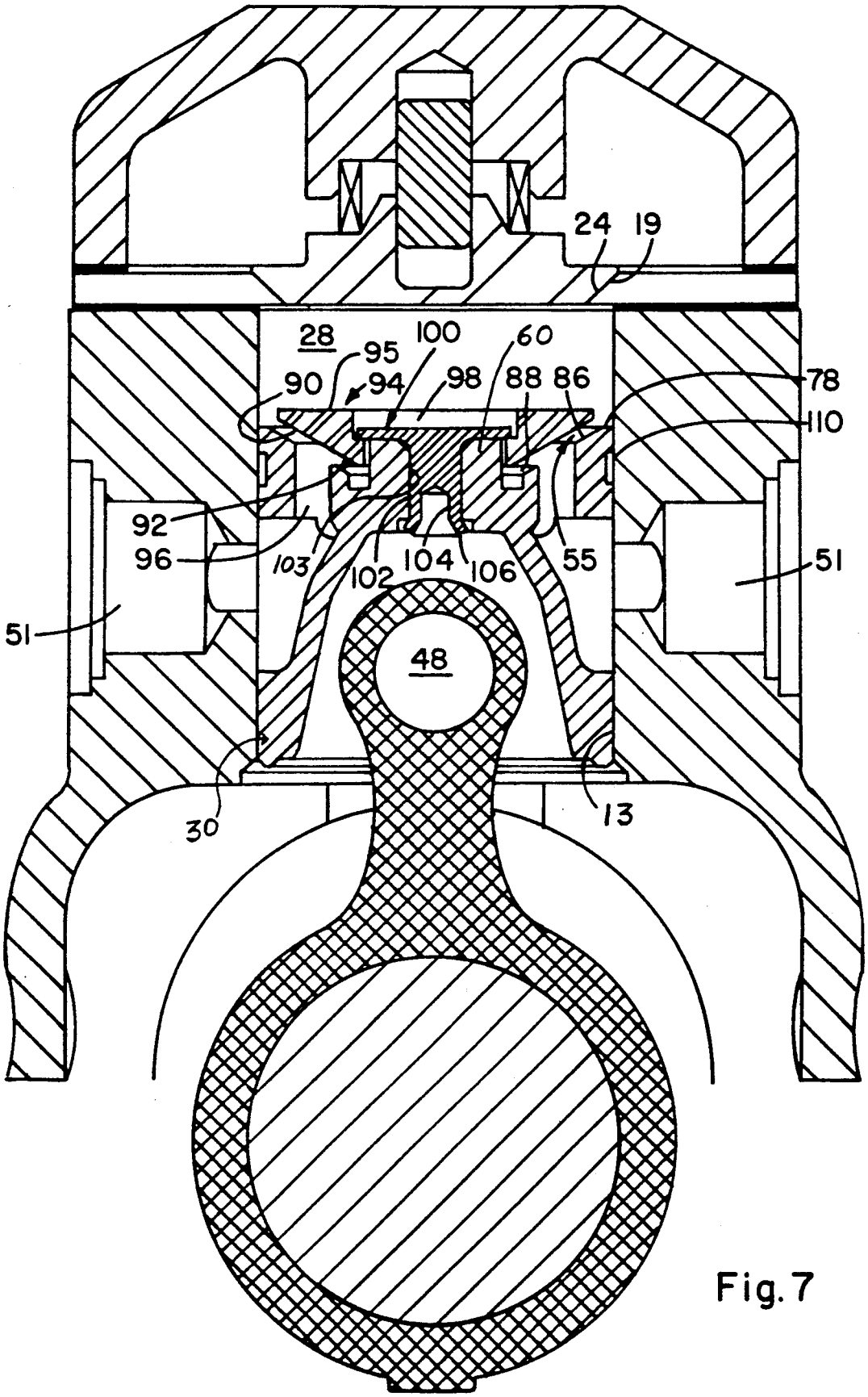
FIG. 7 shows a variation of the inlet or suction valve disc retainer means and suction port seat structure of FIG. 1.

Referring to FIG. 7 which is approximately 1.5 times the actual dimensions of one particular model of the present compressor, a variation of the valve disc seat is shown as comprising double, substantially concentric annular seats or seat lands 86 and 88 which are adapted to seal against annular seats 90 and 92 respectively comprising portions of the beveled surface of valve disc 94, on the compression stroke. With the suction port aperture 55 thus sealed, the annular cavity 96 which is the equivalent of cavity 52 of FIG. 1, is completely closed off from compression chamber 28 even though the access opening 98 in the top of valve disc 94 is not sealed by any means such as access cover 74 as shown in FIG. 1. In this embodiment the metal retainer plate 100 is preferably in the form of a rivet, the shank 102 of which is recessed at 104 on the end and annularly spread deformed at 106 to tightly lock the retainer plate in position on the piston. Such retainer plate construction can also be employed with the disc of FIG. 1. It is particularly noted that on the compression stroke the upper surface 95 of disc 94 becomes planar with piston top 78.

Figure 8:
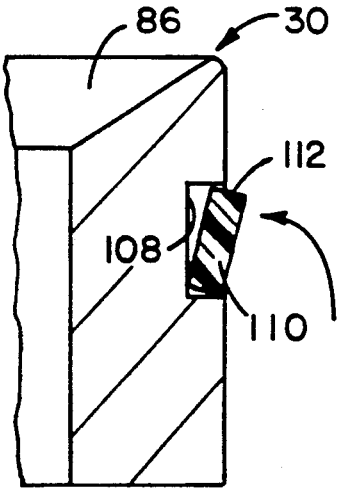
FIG. 8 is an enlarged view of a segment of the piston of FIG. 7 showing a flip seal in place in the wall thereof.
Figure 9:
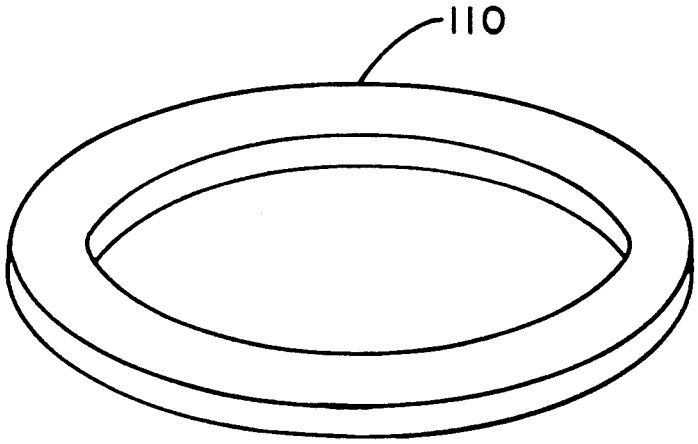
FIG. 9 is a perspective view of the seal of FIG. 8 in unassembled configuration.

Referring to FIGS. 8 and 9, the piston wall surface is provided with an annular piston ring groove 108 into which a flip seal 110 is held under considerable tension. This seal is preferably of a highly abrasive resistant and heat resistant material such as Teflon, polyamide or polyimide, and is normally configured as shown in FIG. 9. The inner diameter of the seal is less than the diameter of groove 108 such that when the seal is forced slid down over the piston and into the groove, the stretching forces on the inner diameter of the seal will cause its outer rim 112 to spring upwardly in an arc as indicated by the arrow in FIG. 8. Thus when the piston and seal are inserted into the cylinder, the seal will tend to outwardly flex to its posture as shown in FIG. 8 to thereby provide both compression and oil sealing against the cylinder wall which is important where such large inlet apertures as 50 are provided through the piston wall and the total piston wall surface thus greatly reduced in area.

Figure 10:
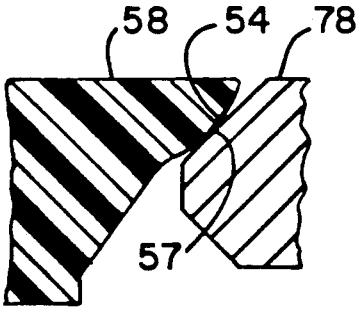
FIG. 10 is a cross-sectional view of a radiused or curved variation of the valve disc seat of FIG. 1.
Figure 11:
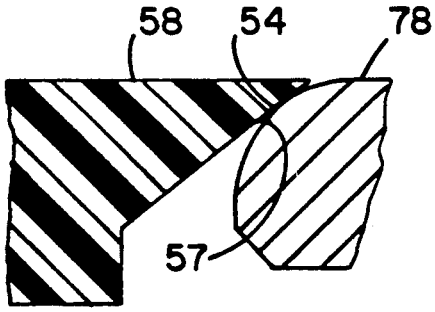
FIG. 11 is a cross-sectional view of a radiused or curved variation of the suction port seat of FIG. 1.

Referring to FIGS. 10 and 11, the valve disc seat 57 or the suction port seat 54, or both may be radiused or curved as shown, with the curve dimensions and configurations being selected to maintain the disc top and piston top in essentially the same plane when the suction port is closed on the compression stroke. It is particularly noted that the discharge valve and port seats 19 and 24 respectively may also be raduised or curved.

Figure 12:
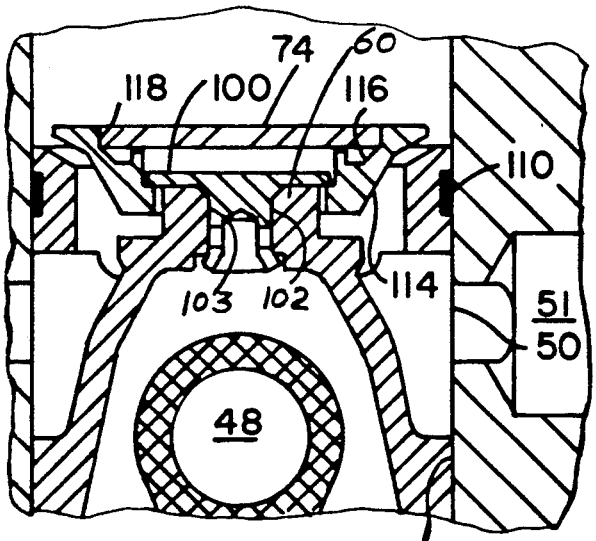
FIG. 12 shows a variation of the valve disc structure of FIG. 1.

Referring to FIG. 12, the upper portion of valve disc 114 is provided with an annular groove 116 underlying the access cover 74. In this embodiment, the access cover is sonic welded into recess 118, for example, at a vibration rate of about 30,000 Hertz by known means and methods. The groove 116 has been found to be quite important in this process for providing a space in which plastic residues or flashings from the welding process are captured.

At this point the preference for the plastic material for the suction valve disc and also for the discharge valve disc, and for their construction as shown is emphasized for the reasons that (1) their construction and light weight allows them to open and close with greatly reduced inertia, i.e., requiring very little energy, (2) contact of these discs with their metal seats and with each other produces little noise, (3) the closing force exerted by spring 22 can be very light since the total evacuation of the pressurized refrigerant from chamber 28 essentially eliminates any dynamic pressure drop across the discharge port which the spring would have to overcome, (4) liquid slugging would have little if any tendency to damage the valves such as can easily occur with metal reed and other types of flex valving, (5) the essentially total discharge of compressed gases from the compression chamber eliminates energy loss through refrigerant reexpansion on the suction stroke, and (6) the extraordinarily capacious inlet and discharge porting provided by this unique construction greatly reduces the energy required to move the desired volumes of refrigerant through the system.

As stated above, various configurations and shapes of the structural components of the present invention may be varied, e.g., the piston, cylinder, valve discs and the like may be of any configuration known to the art such as oval, square, rectangular or the like, however the shapes shown herein are preferred.

The invention has been described in detail with particular reference to preferred embodiments thereof, but it will be understood that variations and modifications will be effected within the spirit and scope of the invention.

I claim:

1. A valve-in-piston unit for use in a gas compressor having first suction gas inlet passage means provided through the cylinder wall thereof remote from the cylinder head, said unit comprising a piston having a generally cylindrical body, suction gas port means provided by suction port seat means formed in the upper surface of said body and by suction valve disc means mounted on the top of said body for limited axial, floating movement toward and away from said port seat means and having valve disc seat means adapted to seal against said port seat means on the compression stroke of the piston and to lift off of said port seat means on the suction stroke of the piston, and second suction gas passage means in said body communicating with said suction gas port means and extending through the side of said body for gas flow communication with said first passage means through the cylinder wall over at least a substantial portion of the travel of said piston in said cylinder and wherein the only significant pressure or frictional contact of said valve disc means with said piston body during the reciprocating cycle is with the port seat means during the compression stroke.

2. The unit of claim 1 wherein said valve disc means is of light-weight plastic material.

3. The unit of claim 1 wherein multiple second suction gas passage means are provided in said body.

4. The unit of claim 1 wherein the top of the piston body and the compression side of the valve disc means lie essentially in the same plane on the compression stroke when the valve disc seat means and port seat means are in sealing contact.

5. The unit of claim 1 wherein said valve disc means is provided with a plurality of flexible fingers for snapping over retaining means on the top of said piston means to movably secure said valve disc means to said piston means.

6. The unit of claim 1 wherein retaining means on the top of said piston means is provided with a plurality of flexible fingers for snapping over portions of said valve disc means to movably secure said valve disc means to said piston means.

7. A gas compressor having cylinder means, piston means mounted for reciprocation in said cylinder means, cylinder head means and discharge valve means mounted over the end of said cylinder means to provide compression chamber means and discharge chamber means, said discharge valve means means being adapted to open discharge passage means to said discharge chamber means for pressurized gas on the compression stroke of said piston means and to close said discharge passage means on the suction stroke of said piston means, first suction gas inlet passage means through the wall of said cylinder means at positions remote from said cylinder head means, second suction gas inlet passage means in said piston means extending through the outer wall thereof and adapted to be in gas flow communication with said first suction gas inlet passage means over at least a substantial portion of the travel of said piston means, suction gas port means through the top of said piston means and adapted for gas flow communication with said second suction gas inlet passage means, said suction gas port means comprising aperture means encompassing a major area of the top of said piston means and surrounded and defined by port seat means, valve disc means having a substantially planar top and mounted in the top of said piston means for limited axial, essentially frictionless floating movement, and having disc seat means on its outer periphery, said port seat means and said disc seat means being adapted come into contact and form a fluid seal on the compression stroke of said piston means to close off said second suction gas inlet passage means from said compression chamber means.

8. The compressor of claim 7 wherein said valve disc means is of light-weight plastic material.

9. The compressor of claim 7 wherein multiple suction gas port and associated valve disc means are provided.

10. The compressor of claim 7 wherein said seat means of said port means is beveled.

11. The compressor of claim 7 wherein said port seat means comprises two radially spaced and substantially concentric seat lands between which the suction gas flows into the compression chamber during the suction stroke.

12. The compressor of claim 7 wherein the first suction gas inlet passage means is at least partially continuously open to the second suction gas inlet passage means.

13. The compressor of claim 7 wherein the first suction gas inlet passage means is sufficiently remote from said cylinder head means to be essentially uninfluenced directly by the temperature of refrigerant therein.

14. The compressor of claim 7 wherein said seat means of said port means is curved.

15. The compressor of claim 7 wherein the outer wall surface of said piston means is provided with an annular piston ring groove into which a flip seal is held under considerable tension.

16. The compressor of claim 7 wherein said valve disc means comprises a circular body having a suction side and a compression side, each of said sides being substantially planar and substantially parallel to each other, a circular bore extending axially through said body and said sides, shoulder means on the wall of said bore adjacent said suction side, the periphery of said body having a curved disc seat extending in a generally radially inward direction from adjacent said compression side towards said suction side, and cover means affixed in said bore and having its outer surface lying substantially in the plane of said compression side of said valve disc means.

17. The compressor of claim 7 wherein the ratio of the maximum volume of said compression chamber on the suction stroke to the cross-sectional flow area of said suction gas port means in its full open condition is from about 1.5 to about 8.0.

18. The compressor of claim 17 wherein the said ratio is from about 3.5 to about 6.5.

19. The compressor of claim 7 wherein facing surfaces of said discharge valve means and said suction valve disc means lie in substantially the same plane at the apex of the compression stroke such that essentially all gas in the compression chamber is exhausted therefrom through said discharge valve means.

20. The compressor of claim 19 wherein said discharge valve means and said suction valve disc means are of plastic material.

21. The compressor of claim 7 wherein said valve disc means comprises a circular body having a suction side and a compression side, lack of said sides being substantially planar and substantially parallel to each other, a circular bore extending axially through said body and said sides, shoulder means on the wall of said bore adjacent said suction side, the periphery of said body having a beveled disc seat extending in a generally radially inward direction from adjacent said compression side toward said suction side.

22. The compressor of claim 21 wherein the upper portion of said piston is provided with axially oriented projection means lying radially and axially inward of said port seat means, said valve disc body being positioned on said piston means with said projection means slidably extending generally axially within said bore from said suction side to a short distance above said shoulder means of said bore, and retainer means on said projection means extending over the upper surface of said shoulder means and limiting the upper axial motion of said disc means away from said port seat means, the compression side of said retainer lying substantially in the plane of the compression side of said disc body during the compression stroke.

23. The compressor of claim 22 wherein the compression side of said disc body is provided with cover means sealing the upper end of said bore.

24. The compressor of claim 23 wherein said cover means is sonic welded to said disc body and having its compression side lying substantially in the plane of the compression side of said body.

* * * * *